US009226061B2

(12) United States Patent
Lilley, Jr.

(10) Patent No.: US 9,226,061 B2
(45) Date of Patent: Dec. 29, 2015

(54) SPEAKER ASSEMBLY

(71) Applicant: Daniel T. Lilley, Jr., Raleigh, NC (US)

(72) Inventor: Daniel T. Lilley, Jr., Raleigh, NC (US)

( * ) Notice: Subject to any disclaimer, the term of this patent is extended or adjusted under 35 U.S.C. 154(b) by 0 days.

(21) Appl. No.: 14/470,467

(22) Filed: Aug. 27, 2014

(65) Prior Publication Data

US 2015/0063621 A1 Mar. 5, 2015

Related U.S. Application Data

(60) Provisional application No. 61/871,094, filed on Aug. 28, 2013.

(51) Int. Cl.

| | |
|---|---|
| ***H04R 1/28*** | (2006.01) |
| ***H04R 1/34*** | (2006.01) |
| *H04R 1/02* | (2006.01) |
| *H04R 3/00* | (2006.01) |

(52) U.S. Cl.

CPC ..... *H04R 1/347* (2013.01); *H04R 1/025* (2013.01); *H04R 1/2896* (2013.01); *H04R 3/007* (2013.01); *H04R 2201/029* (2013.01); *H04R 2201/401* (2013.01)

(58) Field of Classification Search

CPC ..... H04R 2209/022; H04R 2225/49; H04R 1/28; H04R 1/02; H04R 1/025; H04R 1/026

USPC ..... 381/345, 351, 352, 387–388, 189

See application file for complete search history.

(56) References Cited

U.S. PATENT DOCUMENTS

| | | | | |
|---|---|---|---|---|
| 3,727,719 | A * | 4/1973 | Yando | 381/345 |
| 7,333,625 | B2 * | 2/2008 | Jacobs et al. | 381/345 |
| 2004/0165739 | A1 * | 8/2004 | Akens et al. | 381/345 |
| 2005/0207603 | A1 * | 9/2005 | Tse | 381/345 |

* cited by examiner

*Primary Examiner* — Suhan Ni

(74) *Attorney, Agent, or Firm* — Ted M. Anthony

(57) ABSTRACT

A speaker assembly provides a system for reproducing low frequency sound and for directing the sound generated both toward and away from a listener, or in any direction desired, by use of an acoustic dipole. The speaker assembly beneficially provides a significantly improved low frequency sound quality, while reducing sound and vibration transmitted to an adjacent space via an airborne or structure-borne pathway. The speaker assembly also beneficially provides for a suitable use in a plurality of environments, including, without limitation, an outdoor environment, a residential setting, or a professional application.

17 Claims, 4 Drawing Sheets

SPEAKER ASSEMBLY

CROSS REFERENCES TO RELATED APPLICATION

Priority of U.S. Provisional Patent Application Ser. No. 61/871,094, filed Aug. 28, 2013, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a speaker assembly that can accurately reproduce sound, and particularly low frequency sound. More particularly, the present invention pertains to a low-frequency speaker assembly that provides balanced and full range low-frequency sound reproduction in environments where interaction with surrounding surface(s) can cause deterioration in perceived sound, while improving low-frequency sound containment characteristics in order to avoid or reduce sound transmitted to adjacent space(s).

2. Brief Description of the Prior Art

Quality and enjoyment of music and sound, as reproduced in a listening space, can be determined by several key factors including, but not necessarily limited to, the following: (1) means by which sound is generated—this affects sound quality because it influences strength and type of sound patterns generated in a listening space; (2) presence of time-delayed acoustic reflections from walls, floors, ceilings, and/or other surrounding objects—these cause unevenness of sound which reduces clarity and detracts from quality of a listening experience; and (3) transmission of low frequency ("bass" range) sounds produced in a source space and transmitted to other spaces (such as, for example, adjacent rooms or properties) by air-borne and structure-borne paths—this can create a disturbance that may be disruptive and/or unpleasant to others. Such unwanted propagation of low-frequency sounds can be especially problematic in multi-unit residential buildings or outdoor venues.

In many cases, sound volume (or loudness) within a listening environment must be limited by the user in order to reduce negative effects, particularly negative effects of low-frequency sound transmission. As a result, a listener (such as, for example, a concert patron or residential user) is often not able to enjoy a sound reproduction system's full capabilities because reproduction of sound—and particularly low-frequency sound—limited or otherwise curtailed in order to reduce disturbance to adjacent property or living spaces. Unfortunately, such volume reduction can also reduce emotional impact and/or visceral quality of reproduced sound.

The physics of sound wave transmission can present a significant challenge to faithful reproduction of music or other sound, particularly in enclosed spaces. Residential and commercial structures, for example, can exhibit wide varieties of acoustic characteristics; such characteristics can be either desirable or detrimental to sound reproduction quality.

It is generally known that certain steps can be taken to improve sound reproduction quality, particularly at frequencies above 200 Hz. Such steps can include, without limitation, some or all of the following, either individually or in combination: use of electronic "equalizers" (band-pass filters), adjusting the type and placement of room furnishings, adjusting the type and placement of room appointments and adjusting the placement of speakers within a room or other space. Mid-range and high-frequency sounds can often be blocked from transmission to adjacent spaces or reduced by employing a variety of different building construction methods, such as, for example, a staggered-stud wall design that primarily attenuates mid-frequency and high-frequency sounds. However, low-frequency sounds are frequently transmitted by structural elements. As a result, such low-frequency sounds are generally more difficult to contain and control than mid-range and high-frequency sounds.

In addition, low-frequency sounds that are produced in a typical room are generally not distributed uniformly throughout said room, primarily due to said room's shape and dimensions. Consequently, the sound level and quality of low-frequency bass sounds in a conventional room can vary widely depending on listener position and can result in tonal unevenness, thereby being heavily reinforced at some room locations while being suppressed at other room locations. A consequence of said tonal unevenness is an unnatural musical effect and, thus, a loss of emotional impact of reproduced sounds (including, without limitation, music and film soundtracks). As a result, perception of a lower fundamental tone, such as, for example, a human voice (approximately 120 Hz) down to the lowest tone of musical interest (approximately 16 Hz), and spatial distribution of sound energy in a room becomes increasingly determined by room dimensions, room geometry, construction methods, construction materiality and objects present within said room.

An interaction of a plurality of sound waves with structural surfaces produces spatial acoustic patterns, or "modes," in a listening area wherein some sound frequencies are magnified, or intensified, and others are reduced. Modes are present in all types of rooms and other enclosures, and often produce sonic irregularities that detract from the quality of reproduced sound. Although electronic equalization and speaker placement can partially address said irregularities, additional problems remain.

At low frequencies, room modes generally dominate a sound field at a listener location. Most low-frequency sound heard or felt by a listener, therefore, is not sound produced solely by a speaker, but rather a composite of both direct and reflected (reverberant) sound waves. As a result of said reverberation, quality and musicality of a bass sound in a room or a space can vary widely over a listening area and across its frequency range at any given location. Bass sound may seem full and resonant at some points in a room, while at other points, the sound may seem thin or lacking in fullness or power.

An operating principle of conventional low-frequency speaker designs is based on a theory of an acoustic "monopole." A monopole sound source can radiate its acoustic output (sound energy) uniformly in all directions and generally in a spherical pattern. A variety of monopole speakers take advantage of certain design options in order to optimize electroacoustic efficiency, frequency range, physical size, and cost. A majority of these design options are usually one of four types of configurations that are variously called "horn" (including, folded horn), "infinite baffle" (including, transmission line), "acoustic reflex" (vented or ported) and "acoustic suspension" ("air suspension"). In said configurations, acoustic behavior of a physical structural enclosure or cabinet is a critical functional component in attainment of a speaker's overall performance, and thus, must be factored into cost of the system.

Consequently, a conventional monopole design has a variety of disadvantages, such as: (1) a sound radiation pattern that can stimulate a room resonance or mode, creating a reverberation, or "hangover" (a form of distortion), of a musical signal as well as uneven sound pressure levels throughout said room; (2) an acoustic excitation and transmission of sound to a floor surface or a wall surface, thereby creating vibration and noise outside of a listening area and often at a considerable distance depending upon a type of building construction; and (3) production of high sound pressure levels in near proximity to the speaker system, thereby inducing strong vibrations that are transmitted to and through support structures and reducing the noise attenuation effectiveness of said structures. Vibration created by this mechanism is efficiently transmitted to another space and an adjacent room, ceiling, and floor surface, which is an undesirable effect.

As a result, there is a need for an electroacoustic solution with a relatively small size that can (1) reduce excitation of acoustic room modes at low frequencies; (2) reduce the low-frequency sound energy transmitted from a source room to an adjacent room and/or space; (3) reduce coupling of vibration from the speaker directly to a building structure; and (4) provide sufficient acoustic output to reproduce a wide dynamic range and wide frequency range of modern recordings and soundtracks.

SUMMARY OF THE INVENTION

The present invention comprises a loudspeaker ("speaker") design that can eliminate or reduce an occurrence and magnitude of a plurality of "real-world" acoustic problems, particularly but not exclusively in rooms and other enclosures, or spaces, thereby enhancing and improving the quality of sound heard by a listener. The design of the present invention can be used to leverage physics of sound radiation from a plurality of dynamic speakers in order to deliver a highly accurate presentation of reproduced sound to a listener, while reducing or eliminating problems associated with conventional low-frequency speaker equipment.

In a preferred embodiment, the present invention comprises a speaker assembly, operation of which is based on an acoustic doublet, or dipole, thereby differing from a conventional monopole speaker design. Sound that is radiated by a doublet speaker is generated by an electrically induced vibration of at least one cone-shaped, flat, or shaped rigid panel of a limited dimension, which can also be referred to as a "driver." The present invention can direct, or beam, sound energy toward and away from a listener, while limiting and reducing the acoustic energy that is delivered to its sides, thereby reducing energy directed toward a sidewall, a floor surface, or a ceiling. Thus, a key component of the design of the present invention is allowing for sound energy that is radiated from a front surface of the speaker assembly to be in pressure "anti-phase" (180-degree phase shift per each half-cycle) with sound radiated from a rear surface of the speaker assembly, thereby canceling or diminishing undesirable effects of room mode excitation by reducing sound that is not radiated toward and away from the listening position.

The speaker of the present invention is capable of reproducing a lowest sonic tone with extreme accuracy, even when said speaker is used in a room or other enclosure that has less than an ideal proportion, volume, or acoustic characteristics. The speaker of the present invention comprises a combination of drivers in such a configuration as to maximize acoustic radiation at a very low frequency (from at least 16 Hz to approximately 120 Hz), while, at the same time, directing sound energy toward and away from an intended listener.

Additionally, in a preferred embodiment, the speaker of the present invention can primarily generate a direct, or non-reverberant, sound field whereby the speaker, and not room/enclosure dimensions or shape, controls what a listener hears and feels. An advantage and benefit of the speaker of the present invention is its ability to provide a listener with a significantly more faithful reproduction of recorded sounds in an important low-frequency range where a plurality of fundamental notes of music are present.

An additional benefit of the present invention is a reduction of low-frequency sound and vibration transmitted from a listening room or enclosure to another room via both airborne and structure-borne sound. Further, the design of the present invention can minimize speaker dimensions and non-sound-generating structure and, therefore, reduce an amount, and ultimately a cost, of cabinetry materials required.

In a preferred embodiment, the present invention comprises a plurality of speaker drivers positioned and mounted in a nested matrix housed within an enclosure. The design and approach of the present invention permits the speaker to be a size that is comparable to, or smaller than, a typical monopole design of similar acoustic power output at very low frequencies. The speaker assembly of the present invention can increase acoustic efficiency of said speaker system at a low frequency and increase its dynamic range capabilities due to increased acoustic loading that is achieved by use of multiple drivers. Thus, the more drivers used within a desired passband, the greater the acoustic efficiency of all drivers used, thereby resulting in higher efficiency and greater potential dynamic range of the speaker assembly.

By combining the speaker drivers of the present invention in a nested array, the speaker assembly of the present invention increases acoustic radiation ratio. Said effect is advantageous to performance of the present invention because placement of speaker drivers in close proximity to each other, and within a tightly confined chamber with radiation ports on opposite sides of the enclosure, increases acoustic efficiency of the speaker driver array while also lowering the natural frequency of all of the drivers, thus reducing electrical power requirements when required to produce very low frequencies. The increased acoustic loading to the loudspeakers helps prevent "over-travel" of the speaker cones, and thus, reduces dynamic distortion at high sound levels and on signal peaks.

Moreover, the present invention comprises a low-frequency producing speaker comprising, without limitation, a physical dimension that is suitable for a wide variety of home and public, professional, or institutional installations; an acoustic bandwidth (usable frequency range), dynamic range (maximum acoustic output), and electroacoustic efficiency to reproduce all notes of a musical interest within a target space; and an ability to project low-frequency sound energy toward a listener and away from a side wall, a floor surface, or a ceiling, thereby minimizing transfer of vibration to any structure on which it is placed and reducing acoustic energy coupled to adjacent rooms, spaces, and properties.

The speaker assembly of the present invention provides a high performance and a high acoustic output from a relatively small enclosure with a reduced footprint and internal volume by way of a specific arrangement of speaker drivers by such means as to minimize a physical distance between the speaker drivers, while achieving a higher radiation efficiency than a traditional dipole design. In addition, the present invention has multiple benefits, including, but not limited to: an improved quality and accuracy of low-frequency reproduction of sound in a variety of spaces and venues, a reduction of low-frequency sound transmitted to adjacent spaces, a reduced size and weight as compared to conventional speaker equipment, a significant and beneficial reduction of sound pressure level in close proximity to the speaker system, and suitability for speaker placement within close proximity to electronic equipment that is sensitive to vibration.

The speaker assembly of the present invention beneficially includes a potential reduction in size compared to a conventional dipole speaker design, thereby making said speaker suitable and appropriate for use in a relatively small space, such as, for example, a conventional residential room, a residential apartment or condominium, a dormitory, an audio retail store, or any other similar environment. The speaker assembly that can accurately reproduce low frequency sound for use in consumer applications (relatively small space), sound reinforcement (studios, large spaces, and outdoor facilities), and professional musical instrument applications (small and large spaces) where clarity of reproduced sound and control of room resonance is desired. The speaker assembly of the present invention can be used in a system configuration with items, such as, for example, personal headsets, headphones, ear "buds" and in-ear monitors (IEM), or any other similar device that can be used with a cell phone, computer, digital tablet, or any other electronic device.

The speaker assembly of the present invention solves several difficult problems concerning attainment of a balanced and full range low-frequency acoustic performance in environments where interaction with a room surface or other object can cause deterioration in perceived sound, while improving sound containment characteristics (and, particularly, low-frequency sound) in order to avoid or reduce sound transmitted to an adjacent room, space or property.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

FIG. 1 depicts a side perspective view of a preferred embodiment of a speaker assembly of the present invention with an internal frame member removed from an external shell member.

FIG. 1*a* depicts an end view of a preferred embodiment of a speaker assembly of the present invention.

DETAILED DESCRIPTION OF A PREFERRED EMBODIMENT

Figure 1:
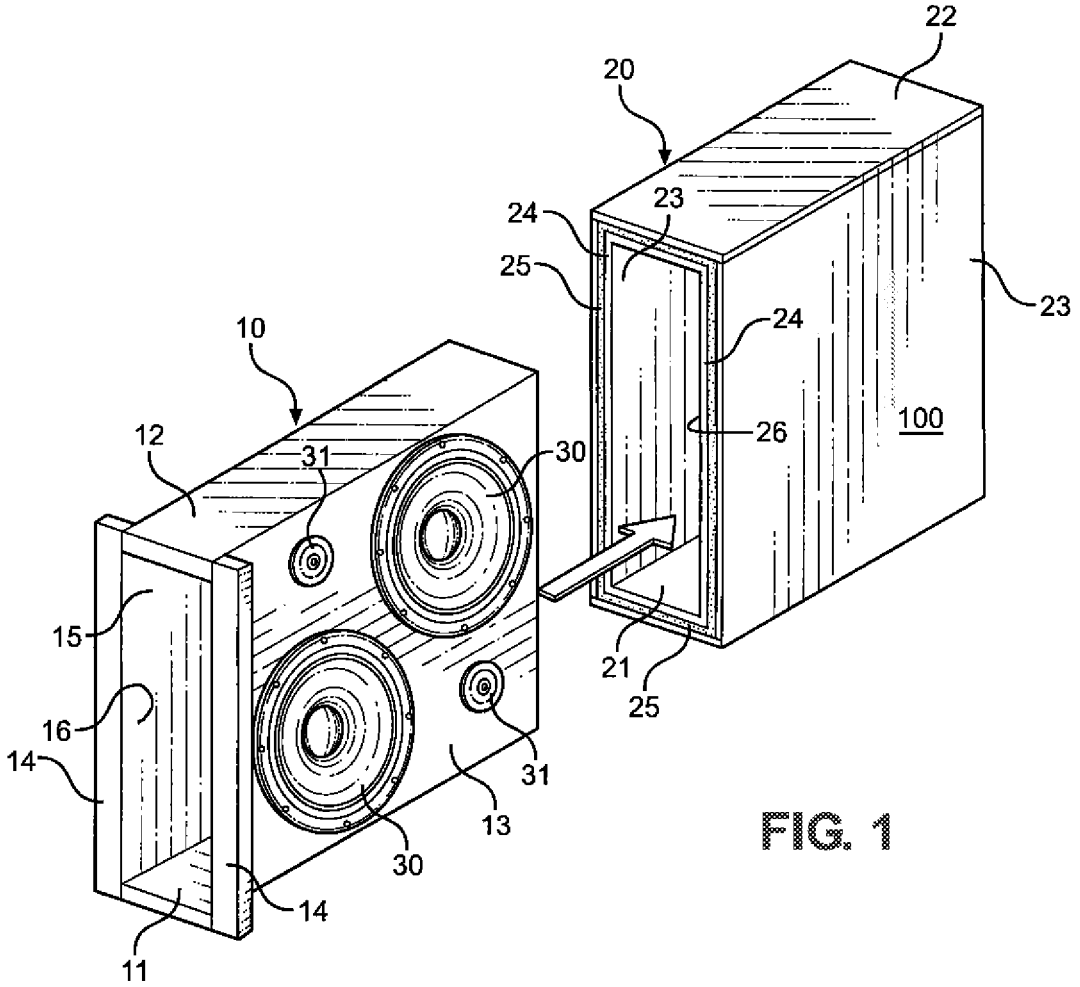

Referring to the drawings, FIG. 1 depicts a perspective view of a speaker assembly 100 of the present invention generally comprising internal or inner frame member 10 defining a cabinet structure that is removed from external shell or housing member 20. Speaker assembly 100 of the present invention can be manufactured in a variety of different dimensions; in a preferred embodiment, said speaker assembly 100 has dimensions of approximately 22 inches in height, 22 inches in depth, and 9 inches in width, and can be constructed from approximately ½ inch medium density fiberboard, or any other material exhibiting desired characteristics.

As depicted in FIG. 1, external shell member 20 and internal frame member 10 can be manufactured from a solid structural material, such as, for example, wood or a simulated wood product, medium density fiberboard ("MDF") or particle board, plastic, composite, or metal material, or any other substantially solid material exhibiting desired characteristics.

In a preferred embodiment, both internal frame member 10 and external shell member 20 of speaker assembly 100 comprise a plurality of panels that are braced and connected via mechanical fasteners, adhesive, or other similar attachment means. Moreover, said internal frame member 10 and external shell member 20 can each further comprise internally located MDF panel(s), a rigid (typically metal or a wood) frame, and coupling or attachment hardware, in order to tightly affix joined components and prevent and/or eliminate vibration while said speaker assembly 100 is in use. As depicted in FIG. 1, internal frame member 10 can be partially received within an inner chamber 26 formed by external shell member 20; said external shell member 20 defines a casing or outer shell that can at least partially encompass or encapsulate internal frame member 10. Still referring to FIG. 1, external shell member 20 generally comprises substantially planar base member 21, substantially planar top member 22 and substantially planar side members 23. Said base member 21 and top member 22 are oriented substantially parallel to each other, while said side members 23 are oriented substantially parallel to each other; said base 21, top 22 and sides 23 cooperate to form inner space or chamber 26 for receiving internal frame member 10.

By way of illustration, but not limitation, said external shell member 20 can include a plurality of furring strips 24 disposed around the opening to inner chamber 26 to which an outer front panel 14 of internal frame member 10 can be attached via mechanical fasteners or other similar attachment means when internal frame member 10 is received within inner chamber 26 of external shell member 20. Furring strips 24 of external shell member 20 can be constructed from an approximately ¾ inch by ¾ inch solid material, and are slightly recessed within external shell member 20. Gasket member 25, which generally comprises low-density foam or other material having desired sealing characteristics, is disposed around the opening to chamber 26. When internal frame member 10 is received within external shell member 30, gasket 25 can safeguard against any loss of acoustic air pressure at an interface of said internal frame member 10 and external shell member 20.

In a preferred embodiment, internal frame member 10 is received and fits within chamber 26 of external shell member 20. In such a configuration, external shell member 20 obscures a plurality of speaker drivers (described below) from view, while providing a solid, rigid surface that, along with internal frame member 10, can cooperate to form an acoustic pathway to direct sound energy in both a forward direction and a rearward direction, ultimately allowing said sound energy to exit said speaker assembly 100. Additionally, internal frame member 10 can be removed from external shell member 20 as a single unit in order to enable efficient replacement or repair of damaged speaker driver, or to substitute a different brand or type of speaker driver, with minimal effort and without altering the dimensions or appearance of speaker assembly 100.

Still referring to FIG. 1, internal frame member 10 generally comprises substantially planar base member 11, substantially planar top member 12 and substantially planar side members 13 and 16. Said base member 11 and top member 12 are oriented substantially parallel to each other, while said side members 13 and 16 are oriented substantially parallel to each other; said base 11, top 12 and sides 13 and 16 cooperate to form inner space or chamber 15. Front panels 14 are disposed around the opening to chamber 15, and extend outward beyond the outer surfaces of side members 13 and 16. Further, external panel 14 of internal frame member 10 comprises a plurality of front edges. Although not depicted in FIG. 1, in a preferred embodiment, the vertical and horizontal inner facing edges of front panels 14, planar base member 11 and planar top member 12 (leading into chamber 15) may be curved or radiused in order to reduce air turbulence that can add distortion to sound when the speaker assembly 100 is operated at a high volume or sound level.

In a preferred embodiment, internal frame member 10 generally comprises a plurality of outwardly-facing speaker drivers 30, mounted on sides 13 and 16 of said internal frame member 10 (typically two on each side). As depicted in FIG. 1, two outwardly-facing speaker drivers 30 are mounted to side member 13; although not visible in FIG. 1, a speaker magnet corresponding to each respective speaker drivers 30 extends through a beneficially positioned aperture in side member 16.

Said internal frame member 10 suspends said plurality of speaker drivers 30 in a relatively static orientation within external shell member 20 in a manner that optimizes air flow and reduces enclosure size. Each speaker driver 30 comprises an approximately 12 inch diameter; however, an alternative driver design, size, shape, and mounting configuration can be selected and used in order to allow for both a larger or a smaller overall enclosure size, thereby allowing for a variety of different room sizes and applications, such as, for example, a recording studio or a sound system monitoring device. Further, in a preferred embodiment, said speaker drivers 30 are generally mounted in pairs (such as, for example, 2, 4, 6, 8, etc.) on sides 13 and 16 of internal frame member 10, thereby allowing for equal sound pressure generation that is symmetrical to sides 13 and 16 of inner chamber 15, and to sides 23 of inner chamber 26 of internal frame member 10 and external shell member 20, respectively.

In addition, although not visible in FIG. 1, it is to be observed that a plurality of outwardly-facing speaker drivers can be mounted to side member 16, on the opposite side of internal frame member 10 from side member 13. As depicted in FIG. 1, speaker magnets 31 (corresponding to the respective speaker drivers mounted to side member 16, but not visible in FIG. 1) can extend through beneficially positioned apertures in said side member 13. In this manner, a plurality of outwardly-facing speaker drivers 30 can be mounted to side members 13 and 16 of internal frame member 10 in an opposing or back-to-back orientation or relationship.

Said plurality of opposing speaker drivers 30 can be operated in an opposition phase, or in an opposing motion, to each other. By way of illustration, but not limitation, speaker drivers mounted to side 13 of internal frame member 10 will be moving in a first direction, while, simultaneously, speaker drivers mounted to a side 16 of said internal frame member 10 will be moving in an opposite direction. Said opposing motion beneficially generates a self-canceling vibration, which is a significant cancellation of enclosure vibration that otherwise could create distortions in radiated sound or could create an unwanted vibration when speaker assembly 100 is coupled to a floor or other mounting structure. Thus, the speaker design of the present invention beneficially eliminates said vibration by physical orientation and electrical connection of said plurality of speaker drivers.

Speaker assembly 100 of the present invention further comprises a plurality of openings, or vents, that function as pathway exits to allow sound energy that is produced inside said speaker assembly enclosure to radiate into a surrounding environment. One such vent or pathway is the opening to inner void or space 15 of internal frame member 10; said opening is located on a front end of internal frame member 10. In a preferred embodiment, said opening has a dimension of approximately 3.25 inches in width by 20 inches in height. Said front opening of said internal frame member 10 is a point where sound emanates from said speaker assembly of the present invention. It is noted that the shape and size of this opening are selected to reduce the excitation of acoustic room modes by virtue of its small size relative to the wavelength of sound radiated within the invention's pass-band.

Figure 1A:
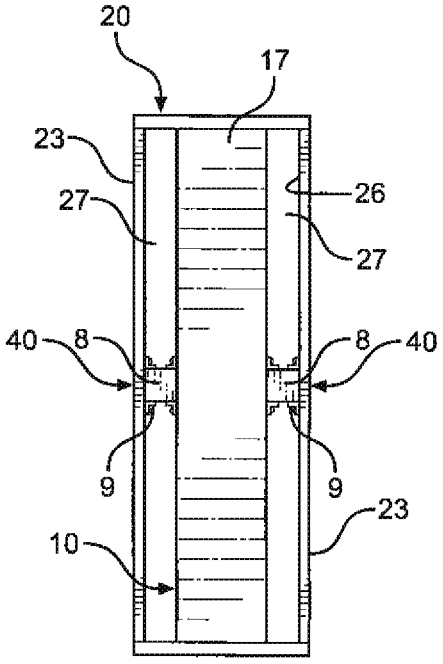

FIG. 1*a* depicts an end view of a preferred embodiment of a speaker assembly 100 of the present invention. Internal frame member 10 having solid rear panel 17 is disposed within chamber 26 formed by external shell member 20. Two of said plurality of sound vents or pathways 27 are located along said rear end of said speaker assembly 100, adjacent to the enclosure side panels and symmetrically sited in a vertical and a horizontal plane, similar to the front opening orientation. Said two rear end openings are also points where sound can emanate from said speaker assembly 100. It is noted that the shape and size of these openings are selected to reduce the excitation of acoustic room modes by virtue of their small size relative to the wavelength of sound radiated within the invention's pass-band.

Still referring to FIG. 1*a*, a plurality of—typically two (2)—bracing assemblies 40 are also located at or near the rear surface of speaker assembly 100. Each of said bracing assemblies 40 comprises a plurality of braces 8 that can be manufactured from an approximately ½ inch thick MDF, or any other suitable material having desired characteristics, in order to provide structural rigidity to external shell member 20, thereby preventing any sympathetic vibration that could otherwise compromise sound reproduction performance of the speaker assembly 100 of the present invention. Additionally, said plurality of braces 8 can be attached via a structural adhesive and/or a plurality of angle brackets 9 using mechanical fasteners, or any other suitable attachment means. Rear panel 17 of internal frame member 10 is beneficially positioned along the rear surface of speaker assembly 100 in a mid-point between the plurality of rear openings 27, as depicted in FIG. 1*a*.

In a preferred embodiment, speaker assembly 100 of the present invention can be situated or fixed to a mounting surface via a mechanically resilient pad, a molded mount, a rigid support, or any other similar mounting device, in order to provide a stable support and to reduce transfer of enclosure vibration to a floor or mounting surface. In addition, an alternative configuration of mounting devices can be used for any other type of installation or for a visual and appearance purpose.

Although not depicted in FIG. 1 or 1*a*, a plurality of electrical connectors, or binding posts, can be beneficially located symmetrically on a rear panel of the external shell member 20 and recessed for an aesthetic purpose, or can have any other placement and orientation in order to achieve an acceptable appearance or for an alternative mode of installation. Additionally, said plurality of electrical connectors can beneficially provide an electrical connection to an external audio amplifier.

Figure 2:
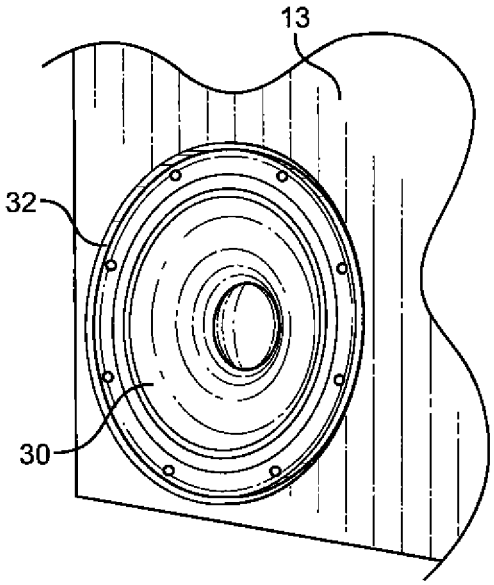
FIG. 2 depicts a side perspective view of a preferred embodiment of a speaker driver of the present invention.

FIG. 2 depicts a side view of a preferred embodiment of a speaker driver 30 mounted to speaker assembly 100 of the present invention. As depicted in FIG. 2, speaker driver 30 is mounted to an outer surface of a side wall (such as side wall 13) of internal frame member 10 of speaker assembly 100 using a back side of an outer flange member 32 of said speaker driver 30. This configuration is used to reduce width of the enclosure that encloses and supports the internal frame without compromising sound generation properties of said plurality of speaker drivers 30. In order to reduce any potential rattle, vibration, or movement, and to ensure a sealed fit between a speaker flange member 32 and the internal frame member 10, a resilient material (such as, for example, a silicone-like substance, flexible sealant, or thin, low-density foam strip) can be applied to a rear surface of flange member 32 and "sandwiched" between said rear surface and an outer surface of side member 13 of internal frame member 10.

Figure 3:
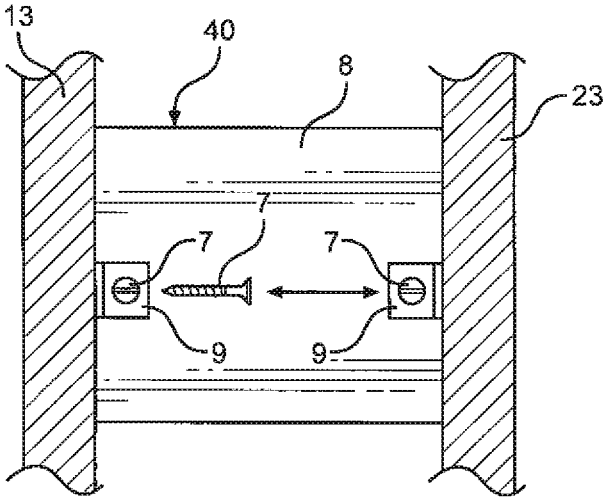
FIG. 3 depicts a front sectional view of a preferred embodiment of an internal bracing member of the present invention.

FIG. 3 depicts a front sectional view of an internal bracing assembly 40 of the present invention. Said internal bracing assembly 40 generally comprises internal frame or brace member 8, metal attachment brackets 9, and wood screws 7. Said bracing assembly 40 restricts vibratory motion of the plurality of internal frame member surfaces and provides a rigid structure that can be used to brace external shell member 20 on both sides of said external shell member 20. By way of illustration, but not limitation, said bracing member 8 can be manufactured from a relatively small section of an approximately ½ inch thick medium density fiberboard (MDF), or any other suitable material having the desired characteristics.

Alternatively, it is to be observed that bracing member 8 can be constructed of other materials, such as, for example, wood, plywood, plastic or metal. Internal brace member 8 can be attached to structural members (such as side members 13 and 23) via a plurality of brackets 9 that can be attached to said brace member 8 and side members 13 and 23, using screws 7 or other attachment means.

Figure 4:
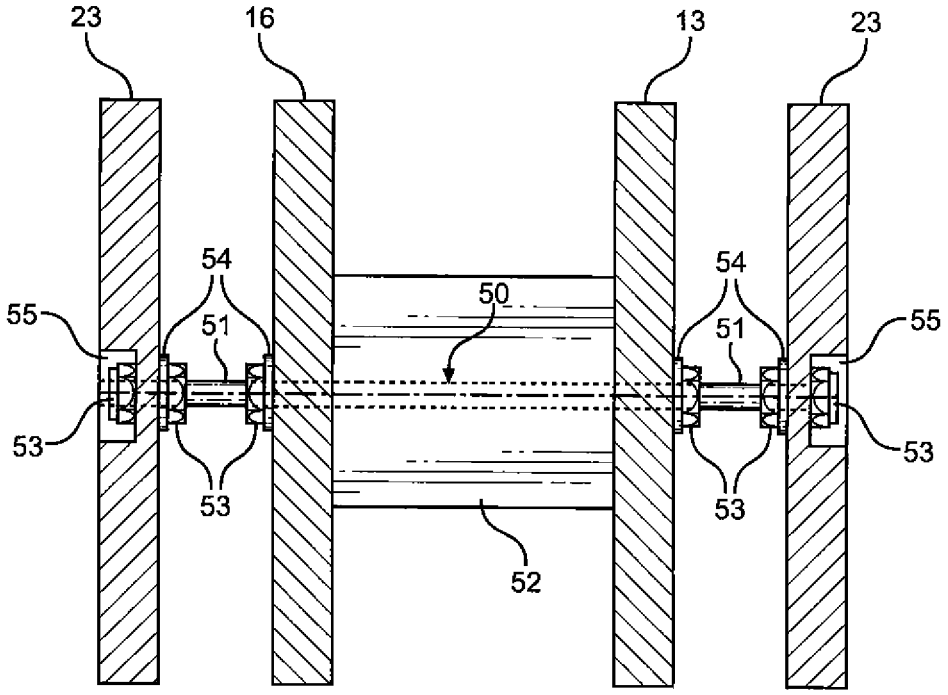
FIG. 4 depicts a front sectional view of a preferred embodiment of an internal hardware anchoring assembly of the present invention.

FIG. 4 depicts a front sectional view of an anchor assembly 50 of the present invention. Said anchor assembly 50 is beneficially connected to both external shell member 20 and internal frame member 10, and is used to secure said components to each other. Bolt 51 (constructed of rigid material having sufficient strength such as, for example, steel, brass, or any other like material) extends through aligned bores in side panels 13 and 16 of internal frame member 10, side panels 23 of external shell member 20, and internal brace member 52. Threaded nuts 53 are threadedly connected to bolt 51 and impart compressive forces to said panel members, while washers 54, or other similar spacers, evenly distribute such loading of the bracing hardware. A shallow hole 55 can be formed within exterior surfaces of side panel members 23 of external shell member 20 to permit the ends of bolt 51 and respective nuts 53 to be recessed or "countersunk". A cap or button (not shown) may then be installed over said holes 55 to improve the visual appearance of the design.

Internal brace member 52 fits between inner side panels 13 and 16 of internal frame member 10, forming a substantially "H" shaped configuration. Further, additional and/or alternative means of securing external shell member panels to said internal frame member panels in order to prevent vibration are also used, such as, for example, braces and other reinforcement means, thereby providing a mechanism of structures that can suppress vibration significantly, while stiffening the external shell member panels in order to prevent forced or resonant vibration.

Figure 5:
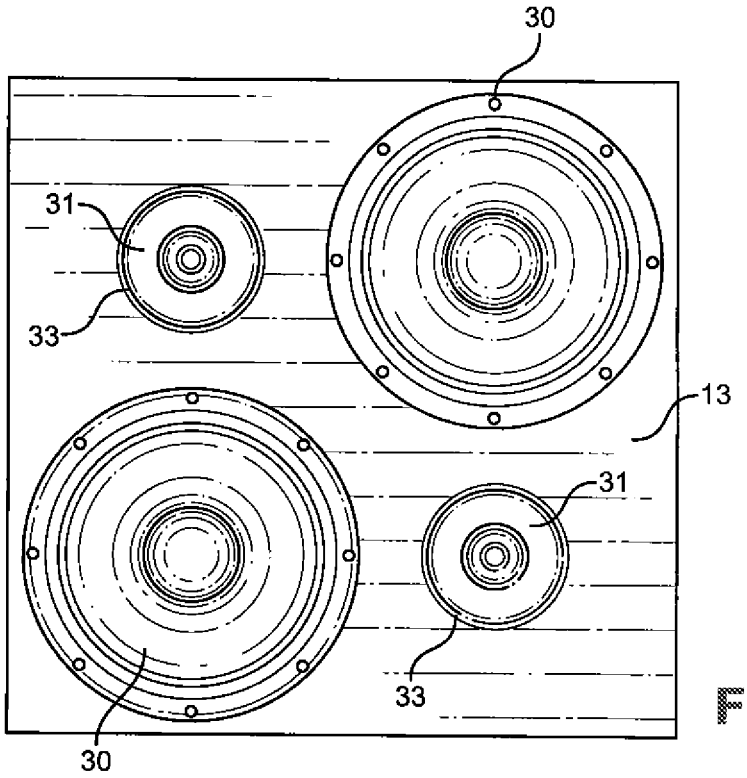
FIG. 5 depicts a front view of a preferred embodiment of an internal panel of an internal frame member of the present invention.

FIG. 5 depicts a side view of a plurality of speaker drivers 30 mounted to a side panel member 13 of internal frame member 10. In a preferred embodiment depicted in FIG. 5, a plurality of—typically two (2)—speaker drivers 30 are mounted to side panel member 13 of internal frame member 10; although not shown in FIG. 5, a like number of speaker drivers 30 are similarly mounted in opposing relationship to an opposing side panel 16 of said internal frame member 10. Magnet assemblies 31 of respective opposing speaker drivers (mounted to opposing side panel 16, but not visible in FIG. 5) are received within beneficially positioned apertures in side panel member 13. Said apertures accommodate a pass-thru of opposing speaker magnets 31. In a preferred embodiment, said apertures each have a slightly larger diameter than a maximum diameter of a speaker magnet 31.

In a preferred embodiment, there is no direct contact or mechanical coupling between said magnets 31 and said side member 13 of internal frame member 10. A flexible sealant material 33 (such as, for example, a silicon sealant, expanded foam, or any other suitable damping material) can be installed in any space present between the outer surface of each magnet 31 and side member 13 to provide a flexible mechanical sealing of any air gap that may be present. As such, there are beneficially no means for coupling vibration of speaker drivers 30 to side panel member 13 of internal frame member 10, while providing a sealed path to prevent airborne acoustic energy from passing across any interface between loudspeaker magnets 31 and the internal frame member 10.

Figure 6:
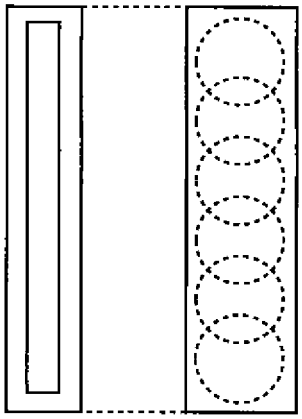
FIG. 6 depicts a side view of an alternate embodiment of a speaker assembly of the present invention with an additional speaker driver configuration.
Figure 7:
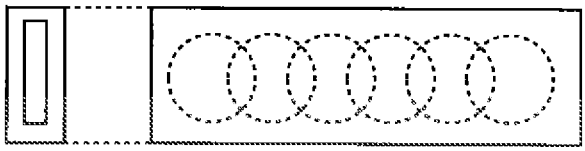
FIG. 7 depicts a side view of an additional alternate embodiment of a speaker assembly of the present invention with a different configuration and dimension.

FIG. 6 depicts a side view of an alternative design variation of the speaker assembly 100 comprising the plurality of speaker drivers 30 in an alternative configuration. FIG. 7 depicts a side view of an additional alternative embodiment of a speaker assembly 100 of the present invention with a different configuration and dimension.

Figure 8:
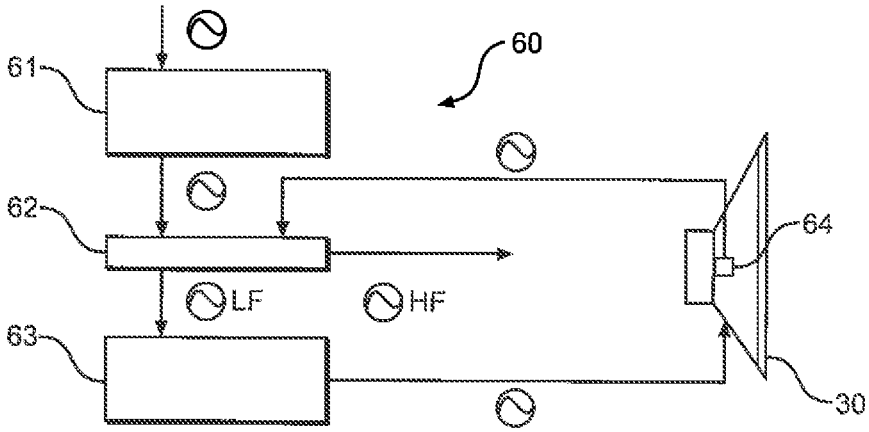
FIG. 8 depicts a schematic diagram of a preferred embodiment of an electrical connection of a speaker assembly of the present invention with additional electronic equipment.

FIG. 8 depicts a schematic diagram of a preferred embodiment of an electrical connection system 60 of a speaker assembly of the present invention. Among other benefits, said electrical connection system 60 provides automatic adjustment of a control signal provided to a low frequency amplification system that provides power to the speaker assembly of the present invention. Use of said electronic equipment depicted in FIG. 8 provides operational linearity of the reproduced sound, especially at high sound power and amplifier power levels, while providing enhanced protection from user abuse or "overdrive" conditions that could cause system failure, thereby ensuring long-term reliability while the speaker assembly of the present invention is in actual use. Functionality of a controller could also include a variety of user interface features in order to allow a user to compensate actively and in real-time, or by prior calibration, for specific room acoustic characteristics and efficiency of an adjunct speaker in an audio or video system. Use of a wireless control signal interconnection (such as, for example, a Blue Tooth data communication system, or any other suitable wireless communication system) between the speaker of the present invention and a controller can also be used. Such interconnections permit the transmission of signal content without the use of wires or physical connections.

Audio preamplifier or integrated amplifier 61 receives and routes an incoming audio signal to electronic circuitry crossover/controller 62. As a "crossover" function, said crossover/controller 62 divides said audio signal into at least two different signals: a high-frequency spectrum (HF) signal and a low frequency spectrum (LF) signal. Said crossover/controller 62 also provides a comparator circuit that can adjust the output gain of said LF signal that drives at least one speaker. The comparator circuitry receives low-voltage signals from a motion detection transducer attached to the moving structure of the loudspeaker.

The HF output signal is routed to a separate audio amplifier (not shown) to provide audio power to an external set of speakers or speaker (not shown). The LF signal is routed to a singular or plurality of audio power amplifier(s) 63 that provides power to the speaker assembly of the invention. Speaker driver 30 (in a preferred embodiment, one of four) is outfitted with an electromechanical transducer 64 such as an accelerometer or other motion detector.

A signal from transducer 64 is routed back to crossover/controller 62 to provide a reference signal that can be used to drive an automatic gain control (AGC) function that automatically (and per a reference transfer function) adjusts the output from said crossover/controller 62 to low-frequency power amplifier 63. Additional or alternative types of electronic circuitry and additional or alternative motion, voltage or current sensing technology may be employed to fulfill this function depending upon end use application and installation parameters.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A speaker assembly comprising:

a. An outer housing having a top, a bottom, a first side wall and a second side wall defining a chamber, wherein said first and second side walls are oriented substantially parallel to each other;

b. An inner cabinet disposed within said chamber of said outer housing, having a top, a bottom, a first side wall and a second side wall, wherein said first and second side walls are oriented substantially parallel to each other;

c. At least one electrically powered speaker driver mounted to said first side wall of said inner cabinet and adapted to direct sound at said first side wall of said outer housing; and d. At least one electrically powered speaker driver mounted to said second side wall of said inner cabinet and adapted to direct sound at said second side wall of said outer housing.

2. The speaker assembly of claim 1, wherein at least one gap is formed between said side walls of said inner cabinet and said side walls of said outer housing.

3. The speaker assembly of claim 2, wherein sound waves are directed from said at least one speaker driver mounted to said first side wall of said inner cabinet through said at least one gap.

4. The speaker assembly of claim 3, wherein sound waves are directed from said at least one speaker driver mounted to said second side wall of said inner cabinet through said at least one gap.

5. The speaker assembly of claim 4, wherein sound waves are directed from said at least one speaker driver mounted to said second side wall of said inner cabinet through said at least one gap.

6. The speaker assembly of claim 1, wherein said top, bottom, first side wall and second side wall of said inner cabinet define an inner space.

7. The speaker assembly of claim 3, wherein sound waves travel through said inner space of said inner cabinet.

8. A speaker assembly comprising:

a. An outer housing having a top, a bottom, a first side and a second side defining a chamber, wherein said first and second sides are oriented substantially parallel to each other;

b. An inner cabinet disposed within said chamber of said outer housing, having a top, a bottom, a first side and a second side, wherein said first and second sides are oriented substantially parallel to each other and wherein:

i. a first gap exists between said first side of said inner cabinet and said first side of said outer housing;

ii. a second gap exists between said second side of said inner cabinet and said second side of said outer housing;

c. A first electrically powered speaker driver mounted to said first side of said inner cabinet and adapted to direct sound at said first side of said outer housing; and d. A second electrically powered speaker driver mounted to said second side of said inner cabinet and adapted to direct sound at said second side of said outer housing.

9. The speaker assembly of claim 8, wherein said outer housing further comprises a front end and a rear end.

10. The speaker assembly of claim 9, wherein sound waves are directed from said first speaker driver through said first gap and out said rear end.

11. The speaker assembly of claim 9, wherein sound waves are directed from said second speaker driver through said second gap and out said rear end.

12. The speaker assembly of claim 11, wherein said top, bottom, first and second sides of said inner cabinet define an inner space having an opening facing said front end.

13. The speaker assembly of claim 12, wherein sound waves travel through said inner space of said inner cabinet and out said front end.

14. The speaker assembly of claim 8, wherein said first speaker driver further comprises a first magnet, and said first magnet is mounted to said second side of said inner cabinet.

15. The speaker assembly of claim 14, further comprising damping material disposed between said first magnet and said second side of said inner cabinet.

16. The speaker assembly of claim 8, wherein said second speaker driver further comprises a second magnet, and said second magnet is mounted to said first side of said inner cabinet.

17. The speaker assembly of claim 16, further comprising damping material disposed between said second magnet and said first side of said inner cabinet.

* * * * *